United States Patent [19]

Walling et al.

[11] Patent Number: 5,073,682

[45] Date of Patent: Dec. 17, 1991

[54] TELECOMMUNICATIONS CABLE

[75] Inventors: Jorg-Hein Walling, Beaconsfield; Oleg Axiuk, Pincourt; Robert Dickenson, St. Lazare, all of Canada

[73] Assignee: Northern Telecom Limited, Montreal, Canada

[21] Appl. No.: 564,804

[22] Filed: Aug. 9, 1990

[51] Int. Cl.[5] ..... H01B 7/00; H01B 13/00

[52] U.S. Cl. ..... 174/70 A; 156/47; 156/51; 174/41; 174/115; 174/117 R

[58] Field of Search ..... 174/70 A, 41, 117 R, 174/115; 156/47, 51; 350/96.23

[56] References Cited

U.S. PATENT DOCUMENTS

| | | | |
|---|---|---|---|
| 2,220,393 | 11/1940 | Bylander | 174/70 A |
| 3,328,510 | 6/1967 | White | 174/41 |
| 4,638,117 | 1/1987 | Ney | 174/117 F |
| 4,776,664 | 10/1988 | Okura | 174/70 A X |

*Primary Examiner*—Morris H. Nimmo
*Attorney, Agent, or Firm*—R. J. Austin

[57] ABSTRACT

A cable for use as aerial service wire having a core of conductors and a load carrier in the form of a plurality of spaced apart tensile reinforcing members spaced from the core as a group laterally on one side of the core. Part of the jacket surrounds the core and is interconnected to another jacket part surrounding the group of filaments. The jacket part surrounding the filament group has a width greater than its thickness so that it may fit within a wedge clamp for stringing purposes. The two parts of the jacket are capable of being separated between the filament group and the core to allow a wedge clamp to be fitted. For this purpose, the cable may be fitted with a non-adherent tape inside the jacket and between the jacket parts with the jacket parts interconnecting around edges of the tape.

9 Claims, 3 Drawing Sheets

TELECOMMUNICATIONS CABLE

This invention relates to telecommunications cable.

In the telecommunications industry, one type of cable is commonly referred to as "aerial service wire" cable which, in use, is strung at its ends between an outside pole and a wall of a customer's premises. Aerial service wire cable may also pass intermediate poles on its way to the customer's premises. The stringing of the aerial service wire cable in this fashion places a tensile load upon the cable and substantially inextensible tensile reinforcing members are required in such cables to provide resistance to any cable extension under that load and subsequent sagging.

In one older design of aerial service wire cable, a core of individual insulated conductors, which is normally one, two or six pairs of conductors, is spaced radially from a longitudinally extending steel load carrier which acts as the tensile reinforcing member. Both the core and the load carrier are embedded within a single jacket having a neck or web between the core and the load carrier. The jacket at each side of the neck or web is substantially circular so as to present a Figure "8" shape in cross-section.

In use of these old designs, the cable is supported at its ends both at the pole and at the customer's premises by spiral clamps. The neck or web at each end of the cable is slit for a required distance along the cable to enable the spiral clamps to be placed helically around the carrier and/or its jacket material by passage of the clamps through the slits and between the carrier and core. When cables extend past intermediate poles, intermediate slits in the cable are required for accommodation of further clamps for attachment to those poles. A problem which exists with the spiral clamps is that it is extremely difficult to place them correctly in position on a cable to provide the desired degree of slack in the cable between the cable supports and, if the degree of slack is discovered to be other than that desired, it is virtually impossible to adjust the clamp position upon the load carrier. Nevertheless, upon the cable entering the customer's premises, the load carrier and its jacket are not required at this location and may be removed. This leaves a substantially circular jacket surrounding the core and simple flexible clips of arcuate configuration may be placed around the jacket and the core and closed down to mount this part of the cable upon either internal or external wall surfaces and supports.

More recently, aerial service wire cables have been used having a small number of pairs (e.g. one or two pairs) of individually insulated conductors and in which tensile reinforcing members of fiberglass have been used as load carriers in place of steel carriers. For providing comparable elongation characteristics to steel the fiberglass required will provide a much higher tensile strength. In such an arrangement, the same spiral clamps used for the steel load carrier would not provide a favorable load transferring grip upon the fiberglass. If a fiberglass carrier were made of a single solid rod of material, it would be too stiff to allow for the flexibility required of an aerial service wire cable. Alternatively, a single fiberglass load carrier formed of many strands not adhered to each other would allow for relative movement between the strands and, with only the outer strands adhering to the jacket material, the inner strands would contribute little, if anything, to the load carrying function. As a result, in the more recent cables, a plurality of spaced smaller diameter fiberglass members have been arranged in various geometrical arrangements together with the conductors to produce structures of flatter appearance than with the older designs of cable. In the more recent designs, either the conductor pairs have been separated by fiberglass reinforcing members or two groups of reinforcing members have been separated by the conductor pairs grouped together with the total positioning being generally planar and the cable having substantial width compared to its thickness. In each case the jacket material which surrounds all of the conductors and reinforcing members is thicker in regions surrounding the reinforcing members than around the conductors. The cable is carried at each pole and at the customer's premises by a different type of clamp referred to as a "wedge clamp" and through which the whole of the cable passes. A wedge action on the clamp compresses the thicker jacket regions thereby gripping the reinforcing members so that the load from the weight of the cable is transmitted through the reinforcing members and into the clamps. A wedge clamp is advantageous in use in that it is easily adjustable upon the cable for providing the desired amount of slack of the cable between support positions. The more recent aerial service wire cables of this structure, because of their shape cannot use the simple flexible arcuate clips to hold them upon wall surfaces and supports within a customer's premises.

It is now becoming desirable to construct aerial service wire cable with load carriers formed by a plurality of tensile reinforcing members which are spaced apart within a jacket material as in the more recent cable structures referred to above, and in which a larger number of pairs of insulated conductors are incorporated into the core. Unfortunately, when using the more recent aerial service wire cable principles upon such designs, it soon becomes apparent that both the thickness and the width of the cable needs to increase substantially beyond that for the present cables and the existing wedge clamps will not be suitable. It follows that if the existing principles of cable construction are to be followed, then for increasing numbers of pairs of insulated conductors in the core, different wedge clamp sizes will need to be employed. This is highly inconvenient and may become impractical when attaching cables to their supports.

The present invention seeks to provide a telecommunication cable which may be used as an aerial service wire cable and in which the above problems are avoided or minimized.

Accordingly, the present invention provides a telecommunication cable having a core comprising a plurality of individually insulated conductors and a cable load carrier comprising a plurality of tensile reinforcing members disposed in a group laterally on one side of and spaced from the core, and a jacket surrounding the core and load carrier and having one jacket portion surrounding the core and another jacket portion surrounding the group with each individual reinforcing member in the group embedded in the other jacket position, and with the jacket portions both extending between the core and the group and being interconnected, the other jacket portion having a thickness in one direction and a width which is greater than the thickness and which extends in a direction transverse to the thickness, the two jacket portions capable of being separated along any desired length region of the cable.

Preferably, the thickness of the other jacket portion extends in the lateral direction of the core.

The tensile reinforcing members of the group may be made of metal, e.g. steel. However, preferably, the tensile reinforcing members are formed from non-metallic materials such as fiberglass, polyaramide fiber, ceramic or graphite and these materials may be in the form for instance of filaments, rovings, or strands.

The group of filaments may be localized in one region of the other portion of the jacket. However, it is preferable that the reinforcing members of the group are distributed throughout the other portion of the jacket so that the group has a thickness across all of the members which extends in the lateral direction of the core and a width across all of the members which is greater than the thickness and which extends in a direction transverse to the thickness. It is also preferable, that the other portion of the jacket is generally of rectangular cross-section so as to render it completely adaptable for us with the existing wedge clamps made for one and two pair aerial service wire cable.

The two jacket portions may interconnect at a neck which is disposed between the group and the core or alternatively a tape layer is disposed between the two jacket portions and the tape layer is non-adherent to at least one jacket portion. In the latter construction, the jacket portions are interconnected around edges of the tape layer so as to completely enclose it.

The invention also includes a method of making a telecommunications cable comprising disposing a plurality of tensile reinforcing members in desired relative positions as a group laterally on one side of a core comprising a plurality of individually insulated conductors; and forming a jacket around the core and around the group and embedding each tensile reinforcing member within the jacket, the jacket being formed with one jacket portion around the core and another jacket portion around the group with the two jacket portions both extending between the core and the group and being interconnected with the other jacket portion having a thickness in one direction and a width which is greater than the thickness and which extends in a direction transverse to the thickness, the jacket being formed so that at the interconnection, the two jacket portions are capable of being separated along any desired length region of the cable.

Embodiments of the invention will now be described, by way of example, with reference to the accompanying drawings, in which.

Figure 1:
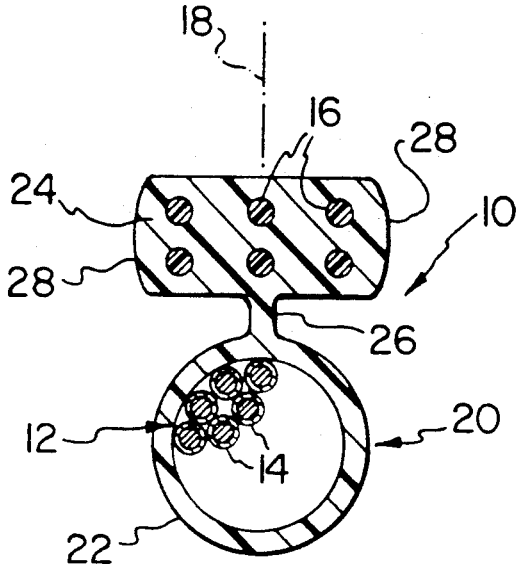
FIG. 1 is a cross-sectional view through a telecommunications cable according to a first embodiment.

In a first embodiment as shown in FIG. 1, an aerial service wire cable 10 comprises a core 12 having twelve pairs of individually insulated conductors 14, each of 22 AWG. Spaced laterally of the core in one direction, is a plurality, namely six, tensile reinforcing members 16 which are arranged as a group in two rows extending transversely of the lateral direction from the core. The members 16 are located in three pairs, with a member of each pair in each row and the pairs are disposed symmetrically with regard to a centerline 18 of the cable which also passes through the axis of the core 12. The tensile reinforcing members are formed from fiberglass in the form of rovings, fibers or strands of diameters between 30 and 50 mils, but could alternatively be formed from polyaramide fiber, ceramic or graphite fibers, for instance. Because of the arrangement of the reinforcing members, they have a thickness in the lateral direction of the core which is less than the width in the transverse direction, i.e. across the centerline 18.

The core and the group of tensile reinforcing members are surrounded by a jacket 20 of polyvinylchloride or any other suitable polymeric material. The jacket which has a first jacket portion 22 approximately 0.04 inches thick and a second jacket portion 24 which surrounds the group of tensile reinforcing members 16 with each reinforcing member embedded within its jacket portion. The jacket 20 is extruded in a single extrusion operation with the portions 22 and 24 connected by a neck 26 which extends between the core and the group of filaments 16. The jacket portion 24 has a shape such as comfortably to encompass the members 16 and has a thickness in the lateral direction of the core which is less than the width in the transverse direction i.e. normal to the thickness. The thickness of jacket portion 24 is approximately 0.155 inches and the width approximately 0.318 inches which extends across slightly convex ends 28 of the jacket portion. This portion 24 of the jacket thus has outside dimensions suitable to be held within a standard or conventional wedge clamp (now to be described) with the neck 26 severed for a distance along the cable, as will be described, to separate the two jacket portions.

Figure 2:
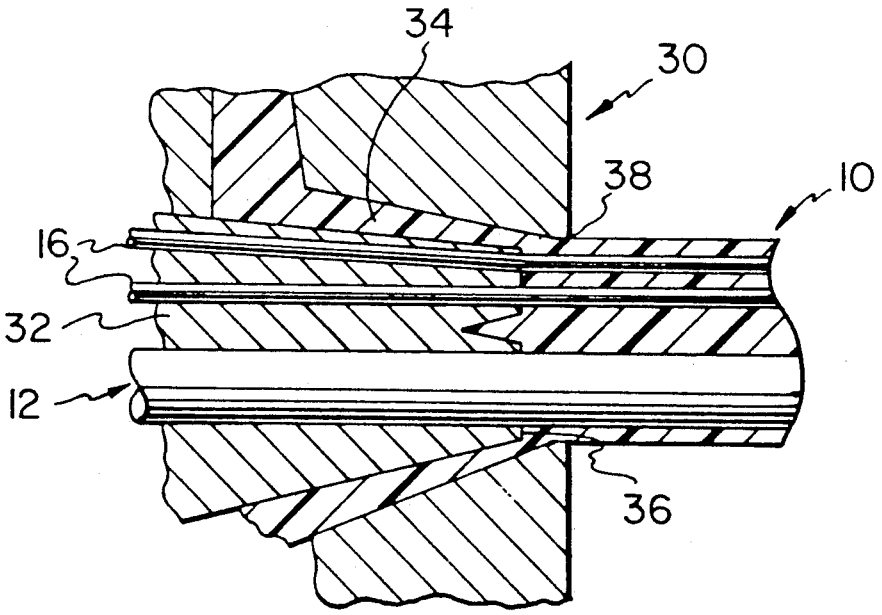
FIG. 2 is a longitudinal cross-sectional view through an extruder head showing one stage in the manufacture of the cable of the first embodiment.

In the manufacture of the cable 10, an extruder head 30 (FIG. 2) is used to apply the jacket to the members 16 and to the core 12. For this purpose, the core 12 is passed through a guide passage in a core tube 32 and the tensile reinforcing members 16 are similarly passed through guide passages in the core tube 32. The core tube 32 is located within an extrusion passage 34 of the head 30 with the outlet end 36 of the core tube disposed slightly upstream from the die orifice 38. Extrudate for forming the jacket 20 passes along the passage of the head and through the die orifice 38 and surrounds the core 12 and all of the reinforcing members 16 which are maintained in their desired positions within the extrudate by the core tube 32 and the tension upon the cable. The die orifice 38 is of complementary shape to the outside shape of the jacket 20 shown in FIG. 1. As the extrudate emerges from the orifice 38, as shown in FIG. 2, the jacket 20 is formed in its final shape and surrounds the core and reinforcing members 16 as shown in FIG. 1. The finished cable is removed by a take-up (not shown).

Figure 3:
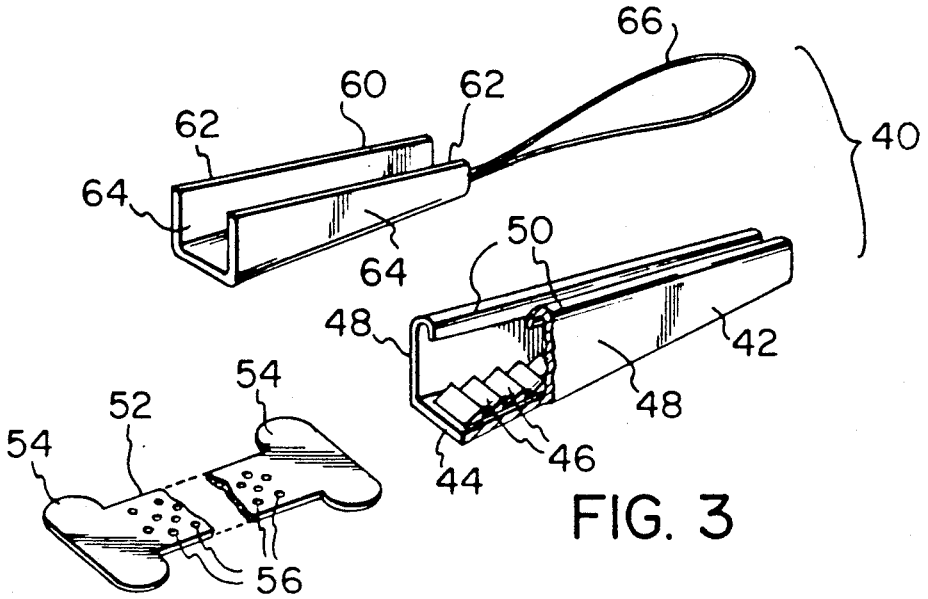
FIG. 3 is an exploded isometric view of a wedge clamp for use with the cable of the first embodiment and to a smaller scale.

A conventional wedge clamp 40 for attaching the aerial service wire cable 10 to poles and to a customer's premises is shown in FIG. 3. This wedge clamp comprises a U-shaped channel member 42 which is tapered from end-to-end as shown. A base 44 of the U is formed with pressed gripping teeth 46 on the inside of the channel, the teeth being oriented to prevent movement of a cable towards the left of FIG. 3, when the cable is held by the clamp as will be described. Sides 48 of the member 42 have turned over free ends 50. The teeth 46 are provided for engagement with one side of the cable and for engagement with the other side of the cable is provided an elongate gripper plate 52 of suitable dimensions to fit between the walls 48 of the member 42. Ends 54 of the gripper plate 52 are of greater width than the remainder and are intended to project outwards beyond the ends of the member 42 so as to prevent longitudinal movement of the plate 52 as is well known. The plate 52 is formed with pressed perforations 56 into its upper surface and these perforations provide downwardly extending barbs 58 (see FIG. 5) which become embedded into the jacket of a cable when downward pressure is applied to the plate 52. The wedge clamp 40 also comprises a pressure applying member 60 which is similarly tapered to the member 42 and is also of U-shaped section so as to comfortably slide within the member 42 towards the right-hand side, as shown in FIG. 3, until upper edges 62 of the walls 64 of the member 60 engage within the turned over ends 50 of the walls 48 with a wedge like action.

Figure 4:
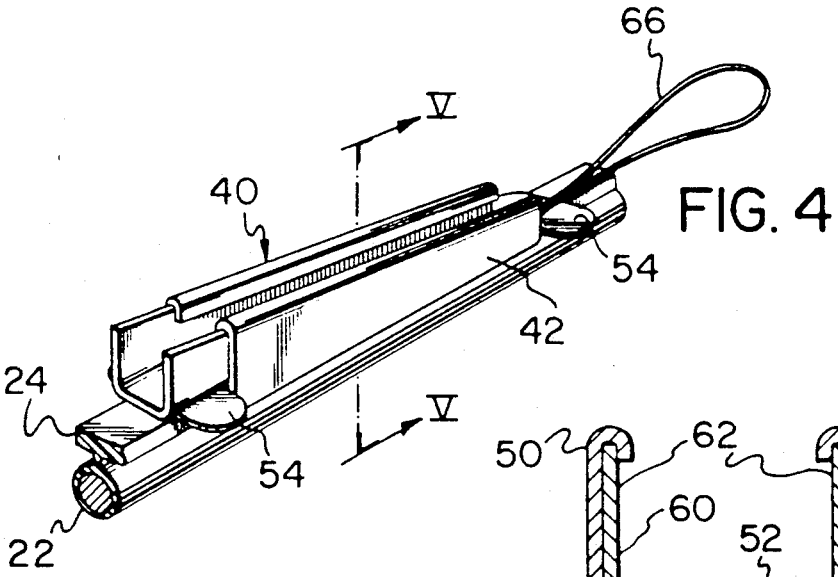
FIG. 4 is an isometric view of the cable of the first embodiment fitted to the wedge clamp of FIG. 3.
Figure 5:
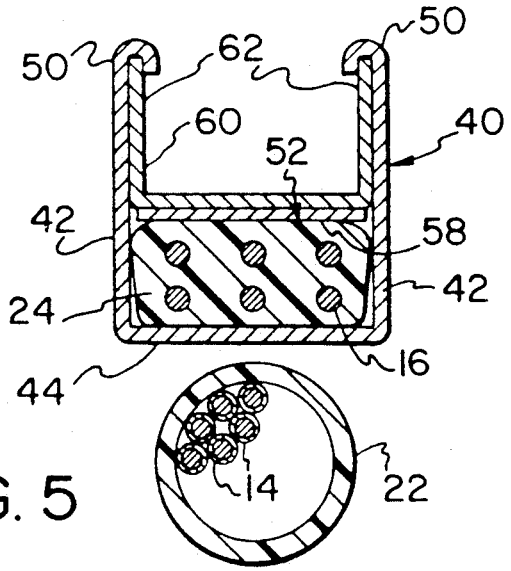
FIG. 5 is a cross-sectional view through the wedge clamp and cable of FIG. 4 taken along line V—V in FIG. 4 and to a larger scale.

To assemble the wedge clamp to the cable 10 in any position, either at the ends of the cable or in an intermediate position, the neck 26 of the cable is slit along the length of the cable for a required distance to insert the member 42 around the jacket portion 24 with the base 44 of the clamp extending through the cut slit between the jacket portions 22 and 24. To assist in forming the slit, a longitudinally extending nick or V-shaped groove may be molded in the neck. In some cases, this will enable the neck to be ripped open to form the slit. Thus, as shown in FIGS. 4 and 5, the member 42 is located around the jacket portion 24 along the slit length of the cable with the base 44 lying between the core 12 and the filaments 16. Subsequently, the plate 52 is located over the jacket portion 24 and the pressure applying member 60 is drawn along the member 42 from the left-hand side, by a handle 66. After engagement of the upper edges 62 of the walls 64 of the member 60 with the inside of the turned-over ends 50 of the walls 48 and upon continued movement of member 60 along member 42, a progressively increasing downward pressure is applied upon the plate 52. This action compresses the jacket portion 24 between the plate 52 and the bottom wall 44 of the wedge clamp so that the barbs 58 embed themselves into the upper part of the jacket portion 24 and the teeth 46 of the clamp embed themselves laterally across the bottom surface of the jacket portion 24. Thus such a clamp on a wire span is essentially self-tightening.

It can be seen from the above, therefore, that the cable 10 of the first embodiment is constructed in such a way as to enable a wedge clamp to be used with the cable so that the tensile reinforcing members, as a group, act as a cable load carrier to transmit the cable loads into the clamp and into the supports for the cable when located in its aerial position. As may be seen in use of the cable structure, whereas a wedge clamp normally surrounds cable cores in use, in this present invention, and as exemplified in the first embodiment, the cable core lies outside of and beneath the clamp itself. It follows therefore that as shown by the first embodiment, a plurality of spaced tensile reinforcing members such as fiberglass, may be used in conjunction with a cable core and be held by a standard wedge clamp while permitting the cable core to be of any desired size or diameter. On this particular point, as shown by FIGS. 1, 4 and 5, the core 12 is substantially large compared to the tensile reinforcing members. The core could be smaller in modifications as required or could even be larger to accommodate more insulated conductors in the core without affecting the action of the clamp upon the second portion 24 of the jacket. Hence, a wedge clamp of one size will suffice for all sizes of core.

Figure 6:
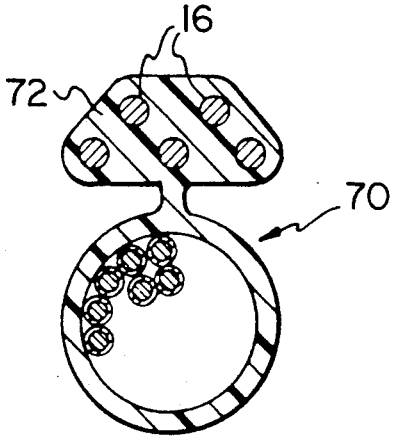
FIG. 6 is a view similar to FIG. 1 of a modification of the first embodiment.

The arrangement of the tensile reinforcing members is of course not critical in the performance of the invention; the critical aspect is the total shape of the second portion of the jacket containing the filaments for acceptance within a single size of wedge clamp. For instance, as shown in FIG. 6, a cable 70 which is a modification of the cable 10, is basically of the same construction as cable 10 except that five tensile reinforcing elements 16 are included in the second portion 72 of the jacket, the members 16 being staggered as shown in FIG. 6 along two rows. The second portion 72 of the jacket follows the outside contour of the group of filaments and thus is tapered towards its top end as shown in FIG. 6. However, the outside dimensions of this second portion 72 of the jacket are still within the dimensional requirements for fitting within the wedge clamp 60.

Figure 7:
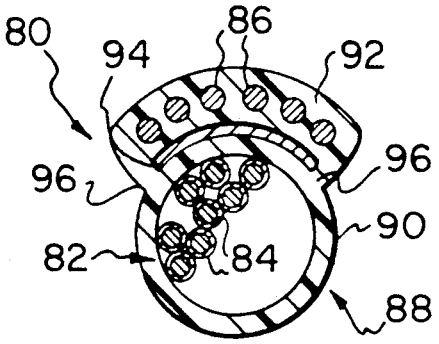
FIG. 7 is a view similar to FIG. 1 of a second embodiment.

In a second embodiment as shown in FIG. 7, a cable 80 comprises a core 82 having twelve pairs of individually insulated conductors 84 arranged in twisted pairs. Disposed laterally out from the core in one direction are six tensile reinforcing members 86 which are disposed in a single row as a group, the row extending partly around the core. The reinforcing members 86 are of the same construction and material as the reinforcing members 16 of the first embodiment. The group of reinforcing members 86 and the core are surrounded by a single jacket 88 having a jacket portion 90 surrounding the core and a jacket portion 92 surrounding the reinforcing members. Between the jacket portions 90 and 92 and thus between the reinforcing members 86 and the core 82 is disposed a tape layer 94 of plastics material which is non-adherent to the jacket material. Plastics materials which are non-adherent to jacket materials are well known in the art. Such a material is that known as Mylar (Trade Mark). The jacket portions 90 and 92 extend around the edges of the tape layer 94 and are interconnected around these edges at positions 96 as shown in FIG. 7. The jacket material at these positions 96 has sufficient cross-sectional area to support the weight of the core from the cable load carrier, i.e. the reinforcing members 86, when the cable is strung between support positions in use.

Figure 8:
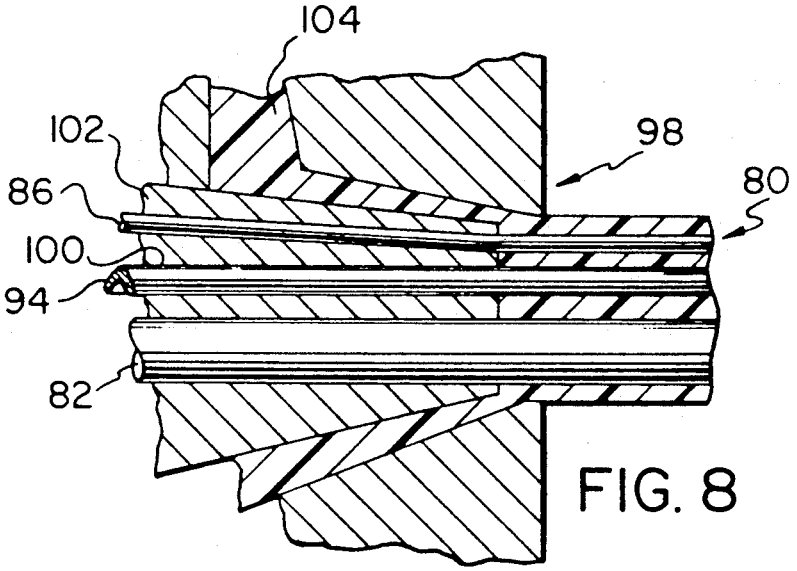
FIG. 8 is a cross-sectional view through an extruder head showing one stage in the manufacture of the cable of the second embodiment.

In the manufacture of the cable 80 an extruder head 98 as shown in FIG. 8 is used. This extruder head 98 is similar in construction to the extruder head 30 shown in FIG. 2 except that a guide passage 100 is formed in a core tube 102 for guiding the tape 94 into position between the reinforcing members 86 and the core 82. As in the first embodiment extrudate 104 moves along the passages of the extruder head and around the reinforcing members 86 and core 82 to form the finished cable 80.

Figure 9:
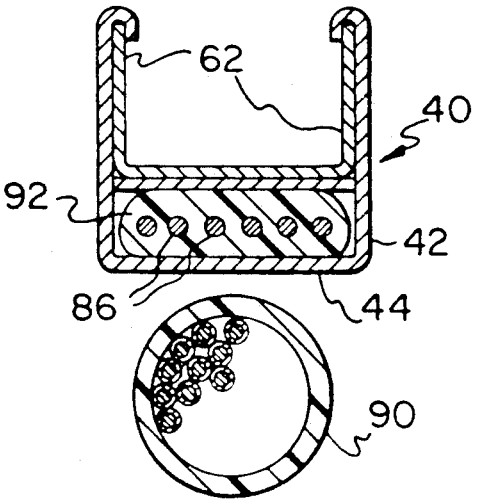
FIG. 9 is a view similar to FIG. 5 showing the cable of the second embodiment assembled to a wedge clamp.

In use of the cable 80, in all length regions of the cable at which a wedge clamp 40 is required, both regions 96 of the cable are cut into until the tape 94 is reached. This successfully separates the jacket portion 90 from the jacket portion 92 along each length region so that the jacket portion 92 may be inserted into the channel member 42 with the base 44 of the member passing between the jacket portions 90 and 92 and across the region occupied by the tape 94. The tape 94 may itself be removed along this length region of the cable, but if not removed, it is preferable for the tape 94 to lie outwardly from the channel member 42 so that, the teeth 46 may engage directly with the jacket portion 92 as shown in FIG. 9. The clamp is then assembled and operated so as to grip the jacket portion 92 for the purpose of having loads transmitted into the clamp from the tensile reinforcing members 86 so as to support the cable. The finished structure of cable and clamp is shown in FIG. 9.

The cable of the second embodiment provides the same advantages as described for the first embodiment and, as discussed above, the core in modifications of the second embodiment may be of any required size for use in the customer's premises. A further advantage which is obtainable with both of the above embodiments is that as the jacket portion surrounding the core is of substantially circular cross-section, then conventional simple flexible clips of arcuate configuration may be used for surrounding the core 82 for holding the core and its jacket portion 90 in position upon walls of the customer's premises. To assist in this, the jacket portion 92 and the tensile reinforcing members 86 which it surrounds may be removed from the length of cable which extends into the customer's premises as in this part of the cable, the load carrier is not required for aerially supporting the cable between supports.

What is claimed is:

1. A telecommunications cable having a core comprising a plurality of individual insulated conductors and a cable load carrier comprising a plurality of tensile reinforcing members disposed in a group laterally on one side of and spaced from the core, and a jacket surrounding the core and load carrier and having one jacket portion surrounding the core and another jacket portion surrounding the group with each individual reinforcing member in the group embedded in the other jacket portion, and with the jacket portions both extending between the core and the group and being interconnected, the other jacket portion and the group of reinforcing members each having a thickness which extends in the lateral direction from the core and a width which is greater than the thickness and which extends normal to the thickness, and the two jacket portions capable of being separated along any desired length region of the cable.

2. A cable according to claim 1 wherein the other jacket portion is of a generally rectangular cross-section.

3. A cable according to claim 1 wherein the two jacket portions interconnect at a neck which is disposed between the group and core.

4. A telecommunications cable having a core comprising a plurality of individual insulated conductors and a cable load carrier comprising a plurality of tensile reinforcing members disposed in a group laterally on one side of and spaced from the core, and a jacket surrounding the core and load carrier and having one jacket portion surrounding the core and another jacket portion surrounding the group with each individual reinforcing member in the group embedded in the other jacket portion, the other jacket portion having a thickness which extends in the lateral direction from the core and a width which is greater than the thickness and which extends normal to the thickness, and a tape layer disposed between the two jacket portions, the tape layer being non-adherent to at least one jacket portion and the first and second jacket portions being interconnected around edges of the tape layer, the two jacket portions being capable of being separated along any desired length region of the cable.

5. A method of making a telecommunications cable comprising:

disposing a plurality of tensile reinforcing members in desired relative positions as a group laterally on one side of a core which comprises a plurality of individually insulated conductors, the group of reinforcing members having a thickness across members of the group which extends in the lateral direction of the core and a width which extends normal to the thickness, and forming a jacket around the core and around the group of reinforcing members with each reinforcing member embedded within the jacket, the jacket being formed with one jacket portion around the core and another jacket portion around the group with the two jacket portions both extending between the core and the group and being interconnected, retaining the reinforcing members in the desired relative positions while the other portion of the jacket is being formed, with the other jacket portion having a thickness in the lateral direction of the core and a width which is greater than the thickness and which extends normal to the thickness, the jacket being formed so that at the interconnection, the two jacket portions are capable of being separated along any desired length region of the cable.

6. A method according to claim 5 comprising forming a neck between the two jacket portions during formation of the jacket.

7. A method of making a telecommunications cable comprising:

disposing a plurality of tensile reinforcing members in desired relative positions as a group laterally on one side of a core which comprises a plurality of individually insulated conductors, the group of reinforcing members having a thickness across members of the group which extends in the lateral direction of the core and a width which extends normal to the thickness, disposing a tape layer between the core and the group of tensile reinforcing members and then forming a jacket around the core and around the group of reinforcing members with each reinforcing member embedded within the jacket, the jacket being formed with one jacket portion around the core and another jacket portion around the group so that the tape layer is disposed between the two jacket portions with the taper layer being non-adherent to at least one jacket portion and enclosing the tape layer within the jacket with the jacket portions interconnected around edges of the tape layer, retaining the reinforcing members in the desired relative positions while the other portion of the jacket is being formed and has a thickness in the lateral direction of the core and a width which is greater than the thickness and extends normal to the thickness.

the jacket being formed so that at the interconnection, the two jacket portions are capable of being separated along any desired length region of the cable.

8. An assembly of a telecommunications cable and a wedge clamp comprising:

a telecommunications cable having a core comprising a plurality of individual insulated conductors and a cable load carrier comprising a plurality of tensile reinforcing members disposed in a group laterally on one side of and spaced from the core, and a jacket surrounding the core and load carrier and having one jacket portion surrounding the core and another jacket portion surrounding the group with each individual reinforcing member in the group embedded in the other jacket portion, the group of reinforcing members having a thickness across members of the group which extends in the lateral direction from the core and a width across members the group and which is greater than the thickness, the width extending normal to the thickness, and with the jacket portions both extending between the core and the group and being interconnected, the one jacket portion and the other jacket portion being separated along a desired length region of the cable and a channel member of a wedge clamp received through the separation between the one and the other jacket portions, the other jacket portion being gripped between the channel member and a pressure applying member of the wedge clamp and with the one portion of the jacket surrounding the core extending laterally of the wedge clamp.

9. An assembly according to claim 8 wherein the core is substantially large compared to the group of tensile reinforcing members.

* * * * *